US008511930B2

(12) United States Patent
Royer et al.

(10) Patent No.: US 8,511,930 B2
(45) Date of Patent: Aug. 20, 2013

(54) COVER FOR A ROAD SYSTEM DEVICE AND CORRESPONDING ROAD SYSTEM DEVICE

(75) Inventors: Jean-Claude Royer, Lesmenils (FR); Vincent Rotharmel, Vandieres (FR)

(73) Assignee: Saint-Gobain PM, Nancy (FR)

( * ) Notice: Subject to any disclaimer, the term of this patent is extended or adjusted under 35 U.S.C. 154(b) by 71 days.

(21) Appl. No.: 13/146,505

(22) PCT Filed: Jan. 20, 2010

(86) PCT No.: PCT/FR2010/050086

§ 371 (c)(1),
(2), (4) Date: Oct. 6, 2011

(87) PCT Pub. No.: WO2010/086539

PCT Pub. Date: Aug. 5, 2010

(65) Prior Publication Data

US 2012/0020729 A1 Jan. 26, 2012

(30) Foreign Application Priority Data

Jan. 27, 2009 (FR) ..... 09 50482

(51) Int. Cl.
*E02D 29/14* (2006.01)

(52) U.S. Cl.
USPC ..... 404/25; 137/371

(58) Field of Classification Search
USPC ..... 404/25, 26; 137/371; 52/19
See application file for complete search history.

(56) References Cited

U.S. PATENT DOCUMENTS

| | | | | |
|---|---|---|---|---|
| 4,690,584 | A * | 9/1987 | LeBaron | 404/26 |
| 7,104,722 | B2 * | 9/2006 | LaCroix | 404/25 |
| 7,770,260 | B2 * | 8/2010 | Fumalle | 16/254 |
| 7,866,915 | B2 * | 1/2011 | Pendleton et al. | 404/25 |
| 8,292,540 | B2 * | 10/2012 | Pickavance et al. | 404/25 |

FOREIGN PATENT DOCUMENTS

| | | |
|---|---|---|
| EP | 0 317 919 A | 5/1989 |
| EP | 1 621 679 A | 2/2006 |
| FR | 2 732 050 A | 9/1996 |
| FR | 2 903 434 A | 1/2008 |

OTHER PUBLICATIONS

International Search Report and Written Opinion for International Application No. PCT/FR2010/050086, dated Apr. 8, 2010.

* cited by examiner

*Primary Examiner* — Gary Hartmann
(74) *Attorney, Agent, or Firm* — Knobbe, Martens, Olson & Bear, LLP

(57) ABSTRACT

A cover for a road system device provided with a frame comprises: a blocking member and a base body defining a covering surface for the road system device, extending in a cover plane, and having a housing for receiving the blocking member. The housing and the blocking member are adapted for blocking the cover relative to the frame or to a neighboring cover. The housing is adapted to maintain the blocking member relative to the base body autonomously and to oppose a movement of the blocking member in a direction extending perpendicular to the cover plane and tending to move the blocking member away from the covering surface. The invention is applicable to access manholes for underground installations.

21 Claims, 10 Drawing Sheets

COVER FOR A ROAD SYSTEM DEVICE AND CORRESPONDING ROAD SYSTEM DEVICE

RELATED APPLICATIONS

This application is a U.S. National Phase of International Application No.: PCT/FR2010/050086, filed Jan. 20, 2010, designating the U.S., and published in French as WO 2010/086539 on Aug. 5, 2010 which claims the benefit of French Patent Application No. 09 50482 filed Jan. 27, 2009.

FIELD OF THE INVENTION

The present invention relates to a cover for a road system device provided with a frame, the cover being of the type comprising a blocking member, a base body defining a covering surface for the road system device, extending in a cover plane, and having a housing for receiving the blocking member, this housing and the blocking member being adapted for blocking the cover relative to the frame or to a neighboring cover, when the blocking member is in the housing.

It applies in particular to device for closing technical inspection chambers of an underground cabled network, such as hatches, and devices for closing access or inspection shafts for an underground water grid, such as manholes or sidewalks.

It more particularly applies to securing manholes or access hatches for telecommunications installations.

These road system devices generally comprise a frame durably sealed in the ground, in which one or more covers are inserted so that they can be released, arranged level with the surface of the ground.

In the case where the device has several covers, these covers are either a so-called slave cover, or a so-called master cover. A master cover can be removed from the frame independently of the potential presence of slave covers, whereas a slave cover cannot be removed from the frame when the master cover is in place.

BACKGROUND OF THE INVENTION

Document FR-A-2 765 256 describes a universal cover for a manhole for connecting chambers.

The cover comprises a base body that includes several attachment protrusions to which it is possible to fasten functional elements, such as hooks or a lock so as to form either a slave cover or a master cover.

Each attachment protrusion comprises surfaces for applying functional elements that are inclined towards each other. The functional elements have surfaces inclined in a manner complementary to those of the attachment protrusions. The functional elements must therefore be made specially for the cover and as a result are costly.

Furthermore, the functional elements are fastened by screws on the attachment protrusions. This fastening means is costly in terms of assembly time and logistics because a large number of components must be stored. Moreover, the screws can be released in an untimely manner.

Also, the functional elements are fastened on attachment protrusions that are not useful when no functional element is attached thereto. The cover is therefore costly in terms of material.

SUMMARY OF THE INVENTION

The present invention aims to propose a cover that allows reliable fastening of the functional elements using simple and economical means.

Other aims of the invention are to propose a cover that requires little material and has a low logistical cost.

To that end, the invention relates to a cover of the aforementioned type, characterized in that the housing is adapted to maintain the blocking member relative to the base body autonomously and to oppose a movement of the blocking member in a direction extending perpendicular to the cover plane and tending to move the blocking member away from the covering surface.

According to specific embodiments, the cover according to the invention includes one or more of the following features:

- the blocking member is a clamp having a core and two wings, in particular substantially U-shaped;
- the blocking member comprises a blocking lug intended to come into contact with a neighboring cover or with the frame so as to block the cover;
- the blocking lug protrudes from the core of the clamp on the side opposite the wings;
- the blocking member is symmetrical relative to an axis of symmetry;
- it has means for subjugating the blocking member on the base body;
- the subjugation means cooperates with the blocking member by shape complementarity, and in particular comprises a pin;
- at least one housing is delimited by a maneuvering recess of the cover, and the housing includes a frangible wall that must be broken so as to put the blocking member in place in the housing;
- the cover includes guide means adapted to guide the blocking member during placement of the blocking member in the housing;
- the base body and/or the blocking member is/are made from metal, in particular cast iron;
- the blocking member is provided with an anti-closure means adapted to oppose closing of the cover when the latter is in an open position.

The invention also relates to a road system device, in particular a manhole, of the type comprising:

- a frame delimiting an access opening;
- at least first and second covers adapted to cover the access opening, characterized in that
- each of the covers is a cover as indicated above, the blocking member being an adaptation member, in that
- each base body is provided with a first housing for receiving the adaptation member, and in that when the adaptation member is in the first housing, the cover is a first type of cover among the even and odd slave covers, and when the adaptation member is outside the first housing, the cover is a second type of cover among master, even slave and odd slave covers, different from the first type of cover.

According to specific embodiments, the road system device includes one or more of the following features:

- the first housing is adapted to receive the adaptation member according to different first and second insertion directions, and when the adaptation member is received in the first insertion direction into the housing, the cover is the first type of cover, and when the adaptation member is received in the second insertion direction into the housing, the cover is a third type of cover among even and odd slave covers, this third type of cover being different from the first and second types of cover;
- each of the base bodies includes a second housing, separate from the first housing and adapted to receive the adaptation member and when the adaptation member is in the second housing, the cover is a third type of cover among even and odd slave covers, this third type of cover being different from the first and second types of cover;

the base body includes a third housing, adapted to receive a second blocking member, and when the second blocking member is in the third housing, this blocking member is adapted to block one side of the cover relative to a side of the frame;

the base bodies of each of the covers are identical;

the two covers are of a different cover type, and the adaptation members of the two covers are identical.

BRIEF DESCRIPTION OF THE DRAWINGS

The invention will be better understood upon reading the following description, provided solely as an example and done in reference to the appended drawings, in which.

DETAILED DESCRIPTION OF THE EMBODIMENTS

Figure 1:
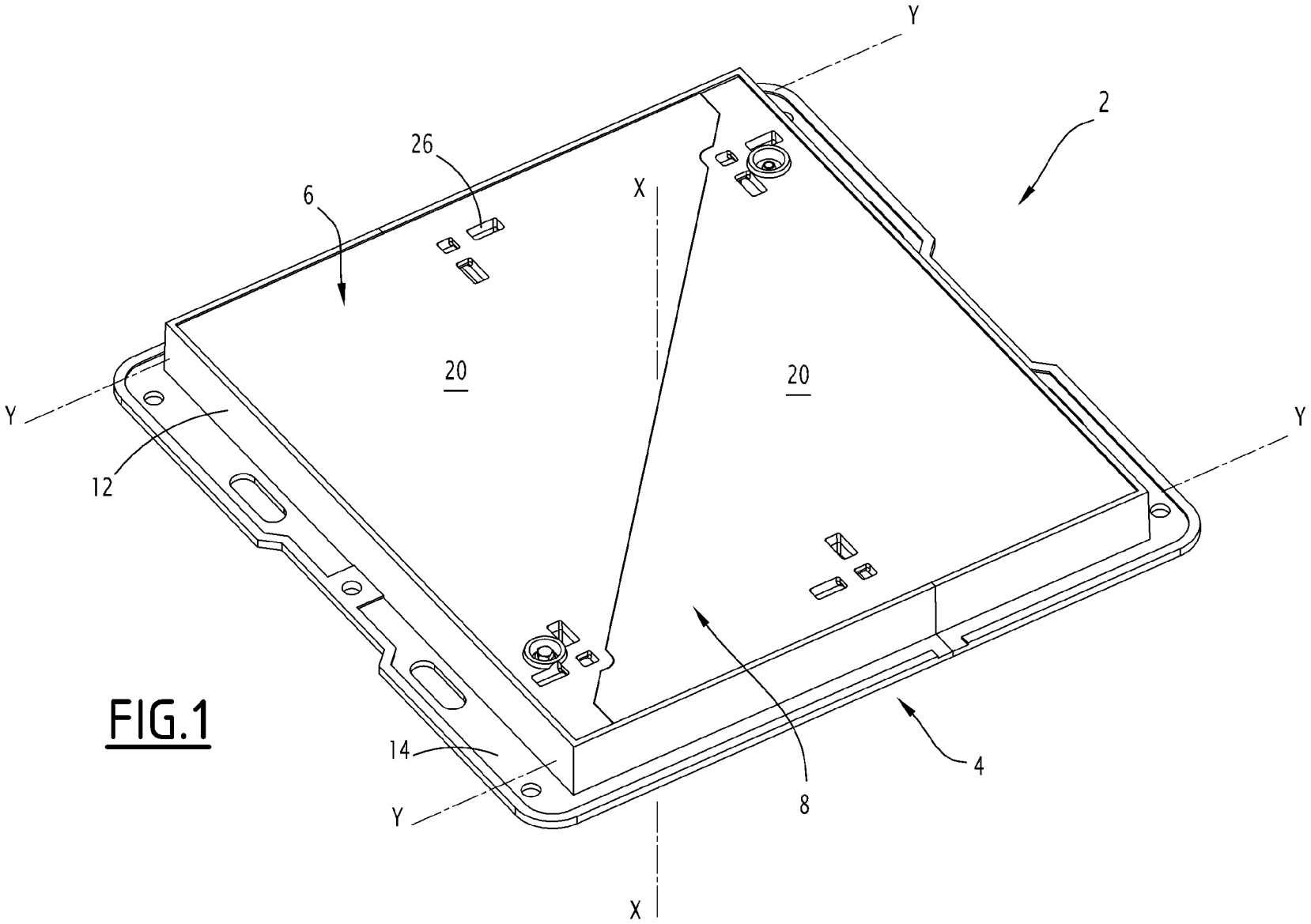
FIG. 1 is a perspective view of the outer side of a manhole according to the invention.

FIG. 1 shows a manhole according to the invention, designated by general reference 2.

The manhole 2 is for example a manhole for a technical underground chamber containing telecommunications equipment.

The manhole 2 comprises a frame 4, a slave cover 6 and a master cover 8.

Figure 6:
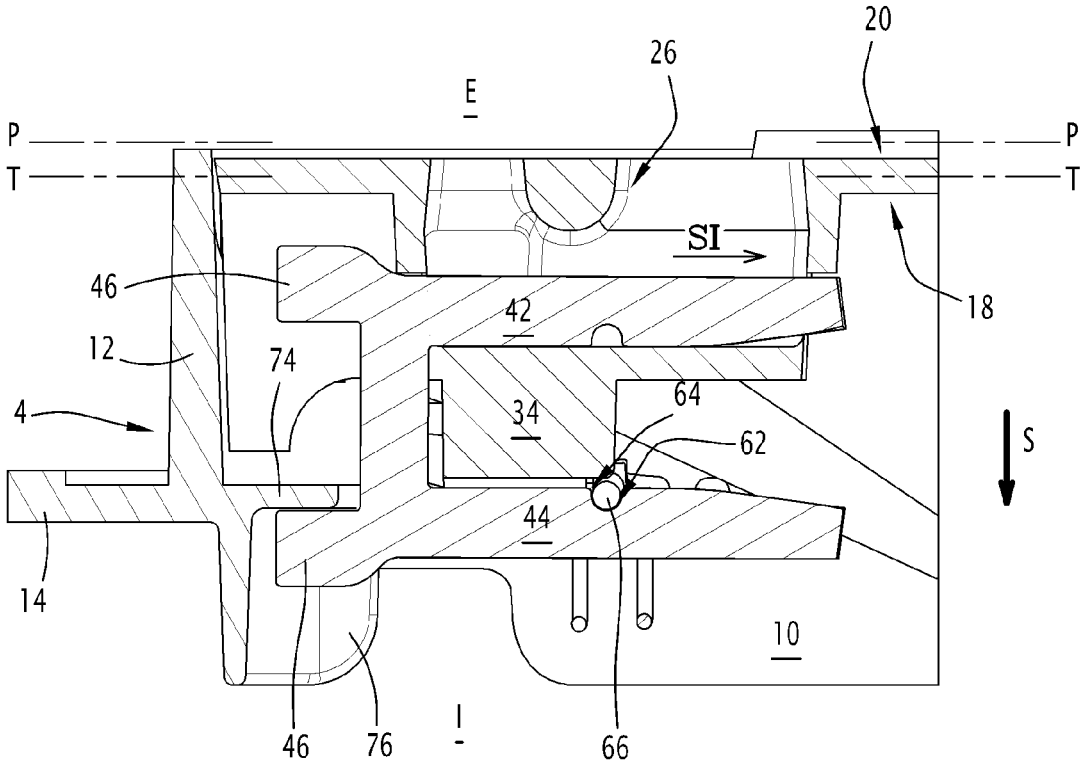
FIG. 6 is a cross-sectional view through part of the manhole, the blocking member being located in the housing and subjugated.
Figure 7:
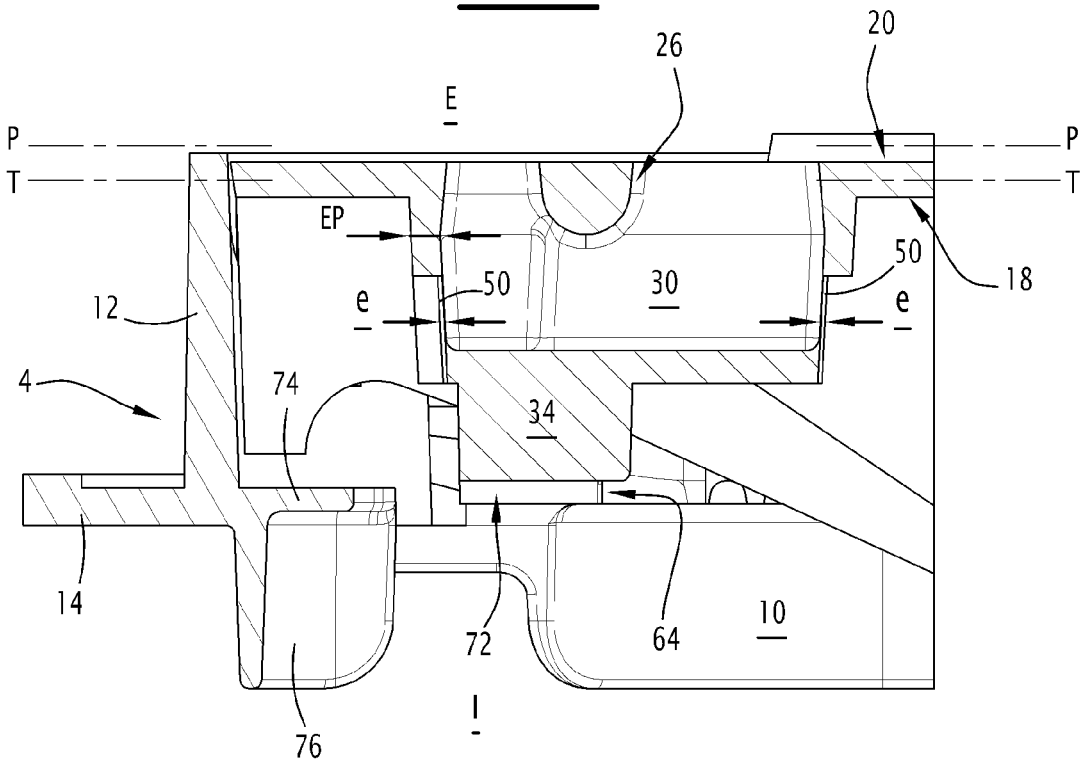
FIG. 7 is a view identical to the view of FIG. 6, before the first placement of the blocking member.
Figure 8:
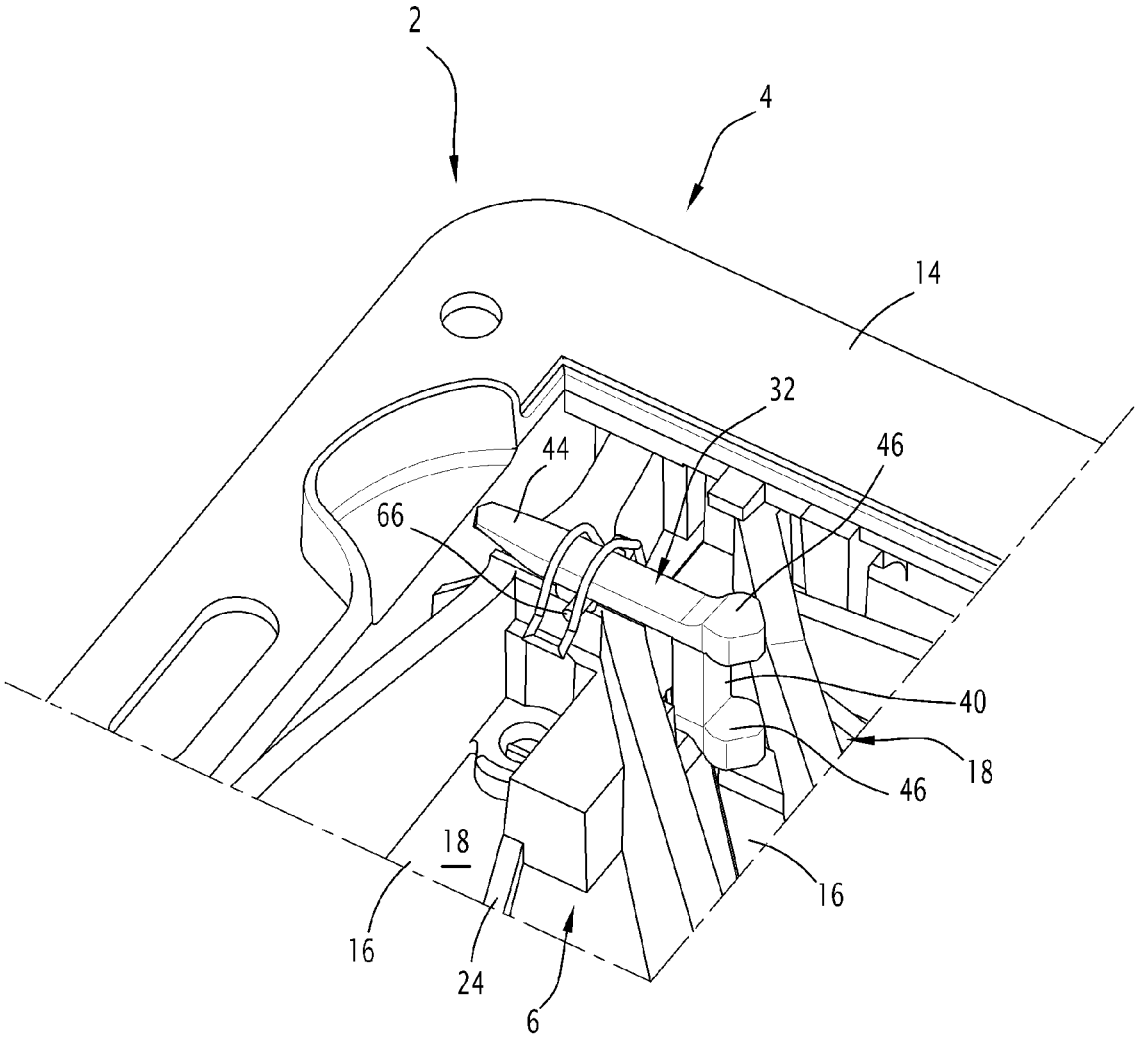
FIG. 8 is a perspective view of the part of the manhole serving to block the slave cover relative to the master cover.

The frame 4 is sealed in the ground and delimits an access opening 10 (FIG. 6), for example an underground chamber comprising telecommunications cables. In the present case, the access opening 10 is square-shaped.

The hole 2 defines a hole plane P-P that extends substantially parallel to the ground during installation.

The hole 2 defines an outer side E and an inner side I. The hole 2 also delimits a central axis X-X extending perpendicular to the hole plane P-P.

In the following, the expression "peripheral" designates the direction moving radially away from axis X-X and "central" designates the direction approaching the central axis X-X.

Moreover, the hole 2 includes, for each cover 6, 8, a hinge (not visible) adapted to make the concerned cover tilt around a hinge axis Y-Y between open and closed positions.

The frame 4 includes a frame wall 12 extending substantially perpendicular to the hole plane P-P.

The frame includes a frame base 14 extending parallel to the hole plane P-P, and protruding radially towards the inside and towards the outside of the frame wall 12. This frame base is intended to be embedded in a sealing material such as mortar.

The master cover 8 can be placed and removed from the frame 4 independently of the presence of a slave cover 6, while the slave cover 6 cannot be removed from the frame 4, or installed therein, when the master cover 8 is in place. Thus, after placement of the slave cover 6, one need only lock the master cover 8 relative to the frame to lock the slave cover 6 in the frame 4.

Figure 3:
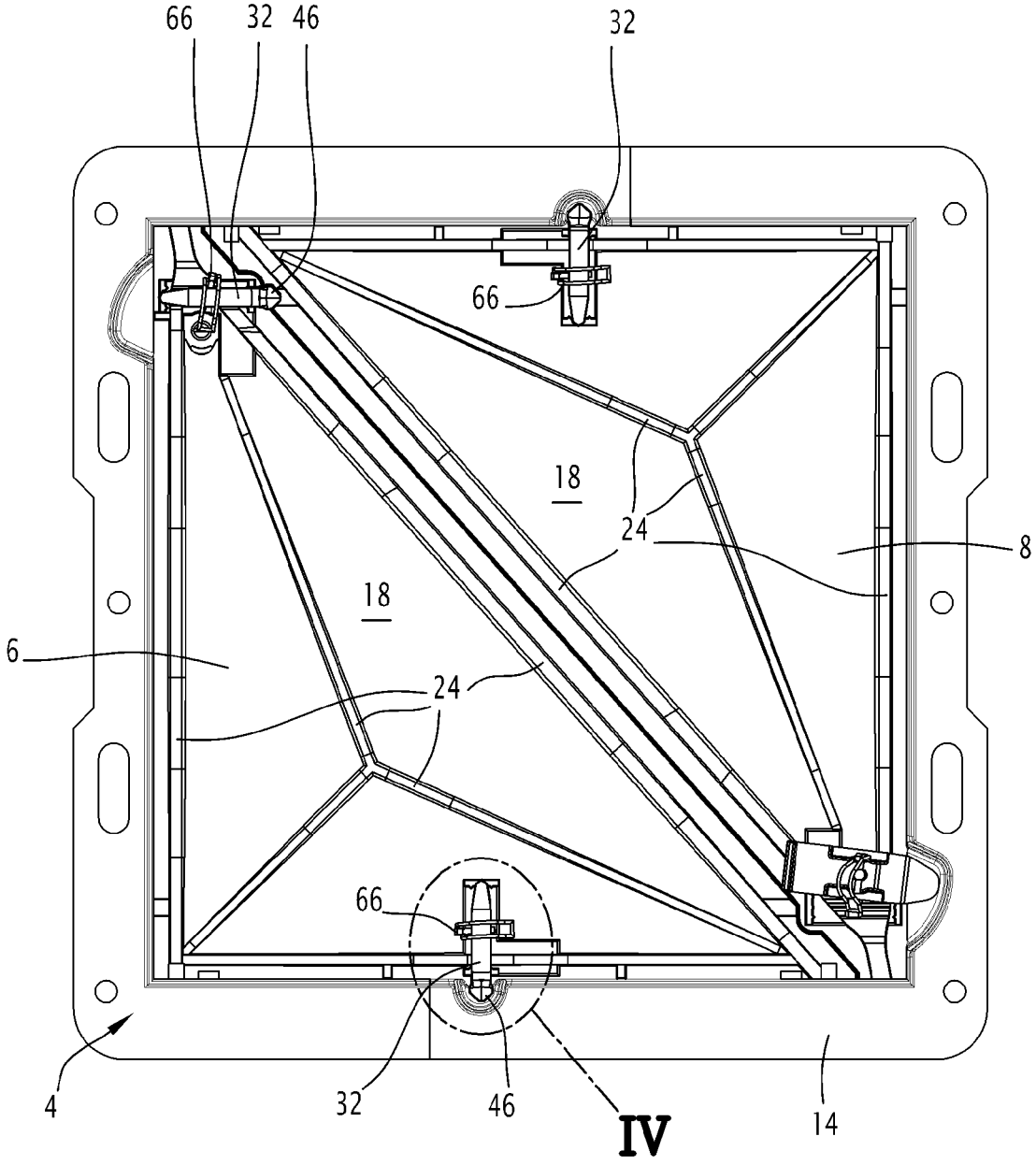
FIG. 3 is a planar view of the inner side of the manhole of FIG. 1, the blocking members being in place.
Figure 4:
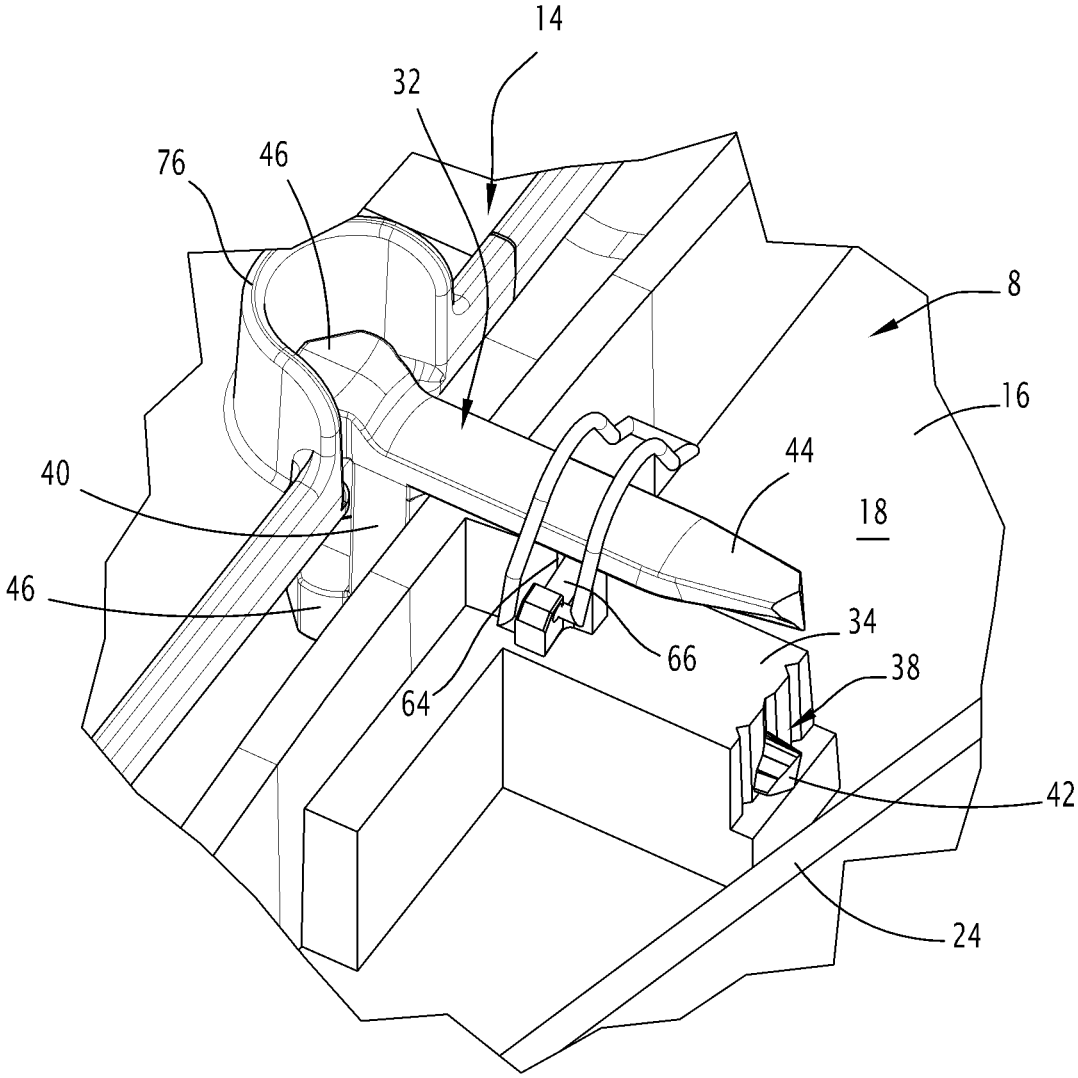
FIG. 4 shows an enlarged and perspective view of part IV of FIG. 3.
Figure 5:
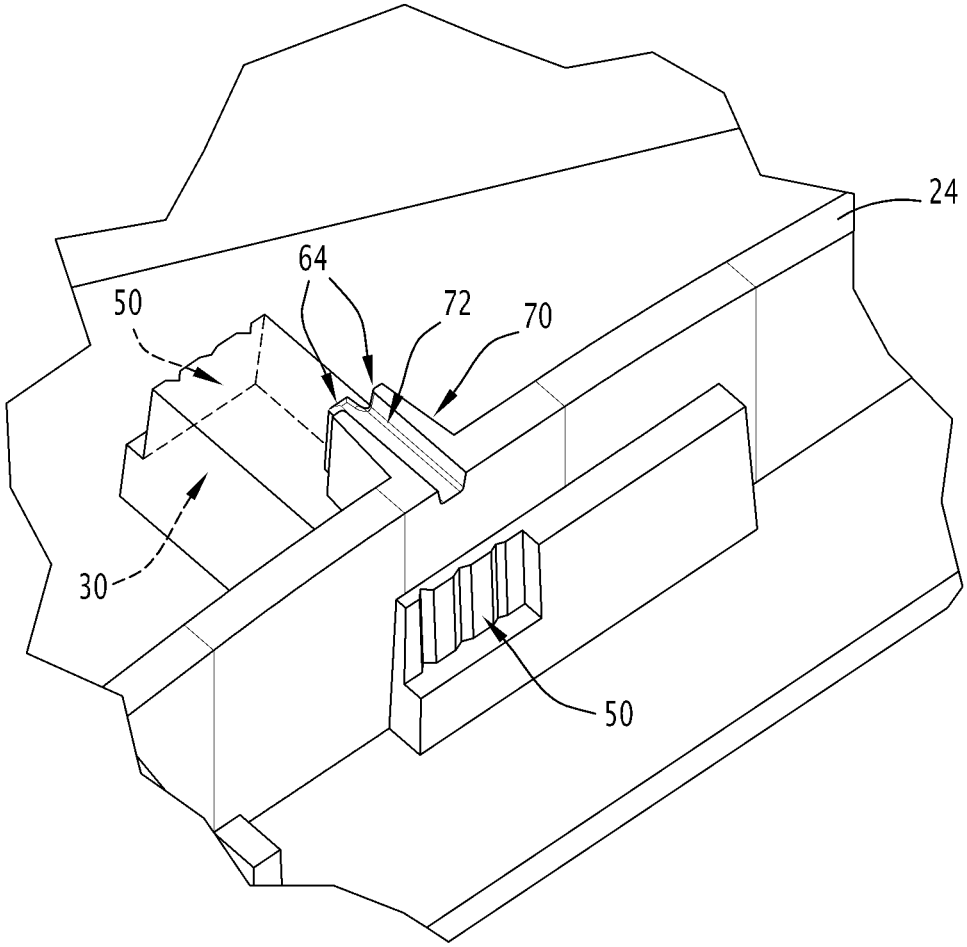
FIG. 5 is a perspective view of the inner side of part of the base body of the cover, before placing a blocking member.

Each cover 6, 8 comprises a substantially triangular generic base body 16, which covers about half of the surface of the access opening 10 and which extends along a cover plane T-T, which is parallel to the plane of FIG. 3.

The base body 16 is identical for each of the slave 6 or master 8 covers. As a result, a single base body 16 will be described below.

The base body 16 is made in a single piece by molding, preferably from cast iron.

Figure 2:
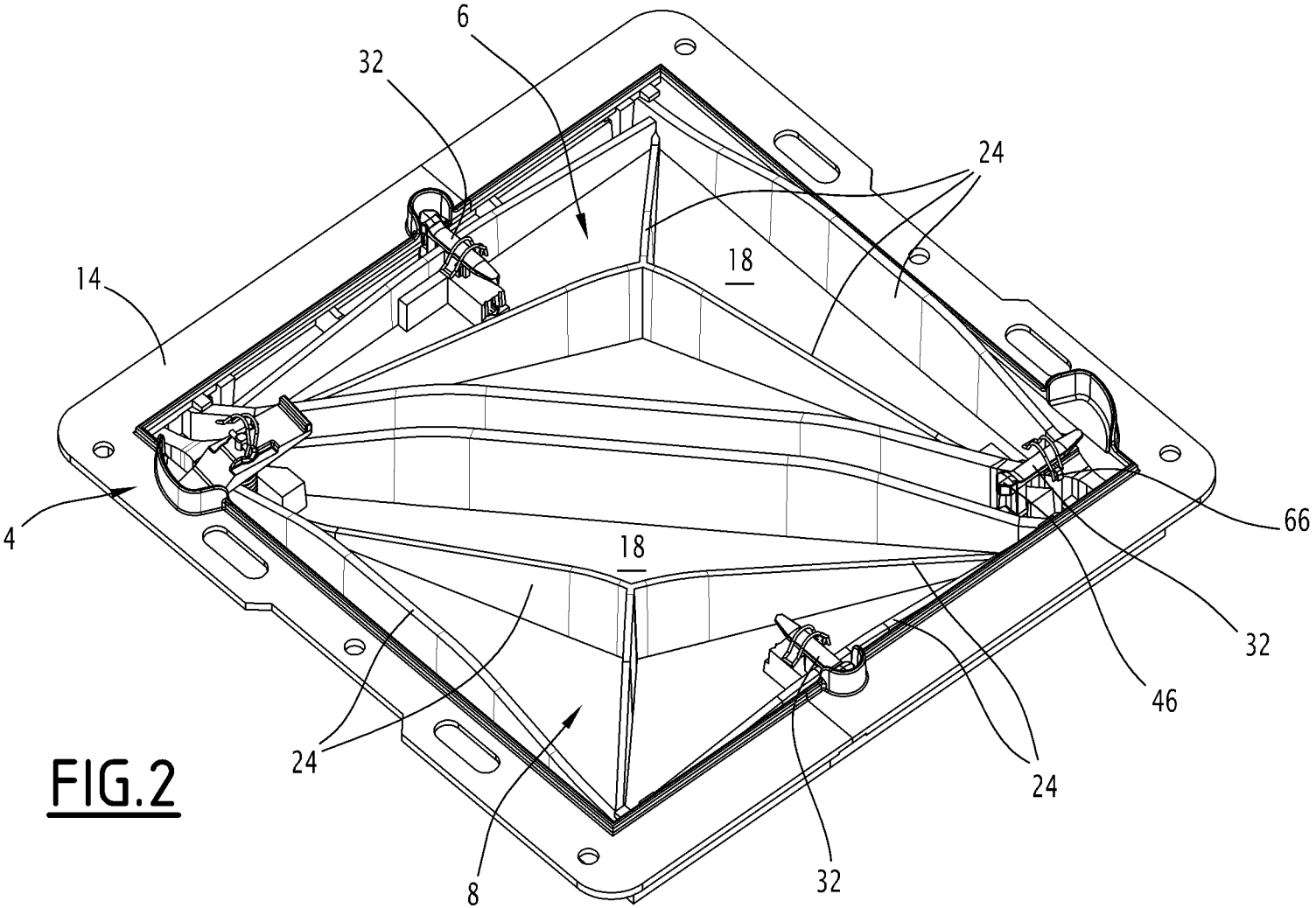
FIG. 2 is a perspective view of the inner side of the manhole of FIG. 1.

The base body 16 comprises an inner surface 18, visible in FIG. 2, and an outer surface 20. The two surfaces 18, 20 are parallel to the cover plane T-T. The inner surface 18 corresponds to an inner side of the cover 6, 8 while the outer surface 20 corresponds to an outer side of the cover 6, 8.

The base body 16 has stiffening ribs 24 on its inner surface 18. Furthermore, the base body 16 includes maneuvering recesses 26 emerging on the outer surface 20. Each maneuvering recess 26 is adapted to receive a maneuvering tool (not shown) intended to maneuver the cover 6, 8 when it is lifted or removed from the frame.

The inner surface 18 of the base body 16 includes a slave housing 28 (even) and a blocking housing 30.

Each cover 6, 8 is also provided with at least one blocking member 32.

The type of slave 6 or master 8 cover is defined by the presence or absence of the blocking member 32 in the slave housing 28. When the blocking member 32 is present in the slave housing 28, the cover constitutes a slave cover 6, and when no blocking member 32 is present in the slave housing 28, the cover is master cover 8. The master cover 8 also has a bolt (not shown) adapted to lock the master cover 8 relative to the frame 4.

Figure 10:
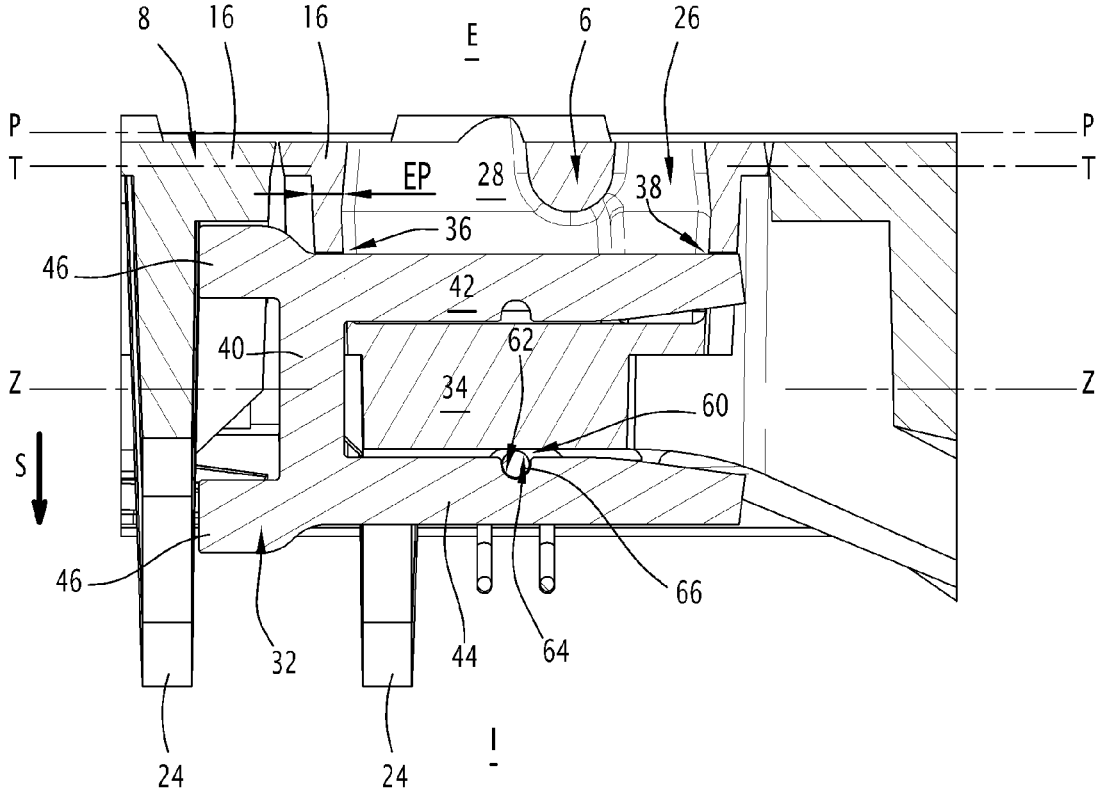
FIG. 10 is a cross-sectional view of the part of the manhole shown in FIG. 8.

FIG. 10 shows a transverse cross-sectional view parallel to axis X-X of the hole 2 at the slave housing 28 of the slave cover 6.

The slave housing 28 includes a bottom wall 34 and two housing openings 36, 38 formed in side walls of the maneuvering recess 26.

The bottom wall 34 extends parallel to the cover plane T-T. The housing openings 36, 38 extend substantially perpendicular to the cover plane T-T.

The slave housing 28 defines an insertion direction SI of the blocking member 32 in said housing 28 that is substantially parallel to the cover plane T-T.

The blocking member 32 is in this case a clamp with a core 40 and two wings 42, 44, the clamp being substantially U-shaped. The blocking member 32 includes a blocking lug 46, and in this case two blocking lugs 46. The blocking lug 46 is intended to come into contact with the neighboring cover, in this case with the master cover 8, so as to prevent the slave cover 6 from being lifted when the master cover 8 is in the frame 4. Each blocking lug 46 protrudes from the core 40 of the clamp on the opposite side of the wings 42, 44.

In the assembled state, one 42 of the wings is in the slave housing 28, while the other wing 44 extends outside the slave housing 28, on the other side of the bottom wall 34.

Advantageously, the blocking member 32 is symmetrical relative to an axis of symmetry Z-Z. Thus, the blocking member 32 can be inserted into the housing 28 in the position indicated in FIG. 10 or in a position rotated by 180° around the axis of symmetry Z-Z, which facilitates manipulation and assembly. In the latter case, the wing 44 is located in the slave housing 28 and the wing 42 is outside said housing 28, on the other side of the bottom wall 34.

The slave housing 28 is adapted to maintain the blocking member 32 relative to the base body 16 autonomously in a direction S extending perpendicular to the cover plane T-T and oriented away from the outer surface 20. In other words, the slave housing 28 is adapted to oppose a movement of the blocking member 32 towards the inner side I relative to the base body 16 in the absence of any other maintenance means. Owing to the fact that the slave housing 28 is formed by the maneuvering recess 26, the base body 16 only requires little material, and in any case, there is no superfluous material in the event the slave housing 28 is not used.

When the base body 16 is manufactured, the housing openings 36, 38 are not necessarily created. When these openings 36, 38 are not formed in a cover during its manufacture, each location of the housing openings 36, 38 is completely covered by a covering wall 50 having a thickness e substantially smaller than the wall thickness EP of the side walls of the maneuvering recess 26 of the base body 16. Preferably, the thickness e is between 0.1 mm and 1 mm. These covering walls 50 form a sealing barrier of the maneuvering recess 26 relative to the inner side I of the manhole 2. Thus, when the blocking member 32 is not placed in the slave housing 28, given that the base body 16 is used for a master cover 8, rainwater or various refuse cannot penetrate the maneuvering recess 26 inside the hole 2.

The wall 50 is frangible and must be broken so as to put the blocking member 32 in place in the slave housing 28 for the first time.

The slave cover 6 also includes a subjugation means 60 of the blocking member 32 on the base body 16. This subjugation means 60 is adapted to oppose removal of the blocking member 32 from the slave housing 28. The subjugation means 60 cooperates by shape complementarity on the one hand with the blocking member 32 and on the other hand with the base body 16. To that end, the blocking member 32 has a subjugation surface 62, in this case delimited by a recess, while another subjugation surface 64 is delimited by the base body 16. The subjugation means 60 also comprises a subjugation member, in particular a pin 66, inserted between the subjugation surfaces 62 and 64.

Figure 9:
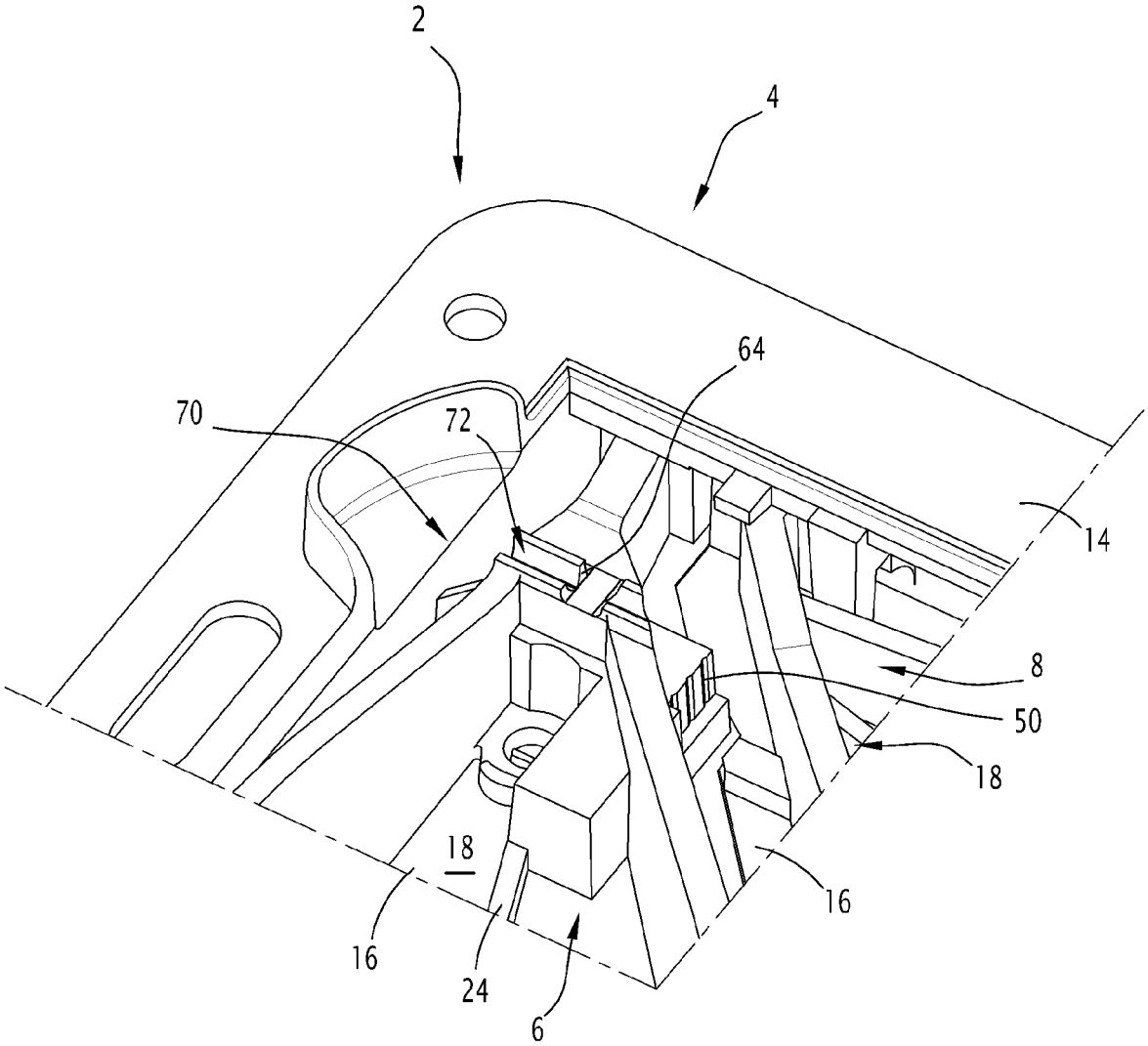
FIG. 9 is a view identical to that of FIG. 8, before the first placement of the blocking member.

The slave cover 6 also has a guide means 70 adapted to guide the blocking member 32 relative to the base body 16 during insertion of said blocking member in the slave housing 28. As emerges particularly from FIG. 9, the guide means 70 comprises a guide groove 72 in which the wing 44 of the blocking member 32 slides when the wing 42 is inserted into the slave housing 28.

Preferably, the blocking member 32 is made from metal and more particularly cast iron. Preferably, the material of the base body 16 and the blocking member 32 are identical so as to avoid corrosion of either of said elements.

FIGS. 4 to 7 show the part of the hole 2 at the blocking housing 30. The blocking housing 30 is adapted to receive a blocking member 32 so as to block one side of the cover 6 or 8 relative to a side of the frame 4. The configuration and the operation of the blocking housing 30 and the blocking member 32 are similar to the operation of the slave housing 28 and the blocking member 32 previously described, and only differ therefrom by the following.

The blocking member 32 does not cooperate with a neighboring cover, but cooperates with the base 14 of the frame 4. More precisely, a blocking lug 46 of the blocking member 32 is adapted to engage under a stop surface 74 of the frame forming a strike for the blocking member 32. This stop surface 74 extends parallel to the hole plane P-P, is situated on the inner side of the base 14 and is delimited by a surrounding wall 76. The surrounding wall 76 protrudes inwardly, parallel to axis X-X, thereby preventing sealing material from penetrating the frame at the location of the stop surface 74.

As emerges from FIG. 3, the blocking element 32 is inserted into the housing 30, both on the slave cover 6 and on the master cover 8, and serves to prevent the slave cover 6 and the master cover 8 from lifting relative to the frame 4.

Moreover, the bottom wall 34 has a stepped inner surface that leads to a low consumption of material and makes it possible to block the pin 66.

Figure 11:
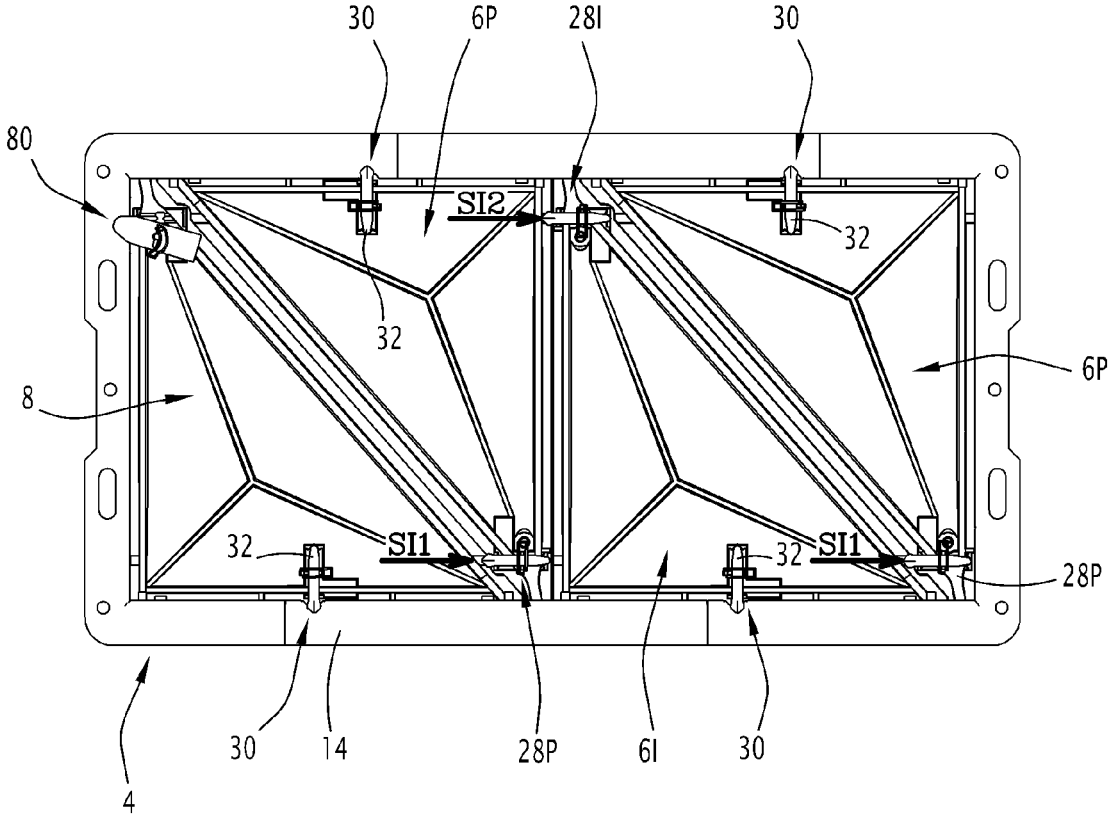
FIG. 11 is a planar view of the inner side of an alternative of the manhole according to the invention.

FIG. 11 shows a manhole 2 according to an alternative of the invention. This manhole 2 differs from the manhole 2 previously described only in the following.

The frame 4 has a substantially rectangular shape. The manhole 2 has a master cover 8 and three slave covers. These three slave covers comprise two even slave covers 6P and one odd slave cover 6I. The two even slave covers 6P are identical to the slave cover 6 previously described.

The even slave covers 6P each comprise a base body 16 having an even slave housing 28P identical to the aforementioned slave housing 28.

In the case of even slave covers 6P, the blocking member 32 is inserted in a first insertion direction SI1 in the even slave housing 28P, this insertion direction SI1 being considered relative to said housing 28P. When the locking member 32 is received in the even slave housing 28P in this first direction, the cover 6 constitutes an even slave cover 6P.

The odd slave cover 6I is arranged between the two even slave covers 6P.

The odd slave cover 6I includes a base body 16 having an odd slave housing 28I identical to the aforementioned slave housing 28 and in which a blocking member 32 extends. The blocking member 32 is inserted in a second insertion direction SI2 in the odd slave housing 28I, this insertion direction being considered relative to said housing 28I. When the blocking member 32 is received in this second direction SI2 in the housing 28I, the cover constitutes an odd slave cover 6I. It should be noted that the second insertion direction SI2 is different from the first insertion direction SI1, and is in the present case a direction opposite the first insertion direction SI1. Thus, in FIG. 11, the two directions SI1 and SI2 are oriented in the same direction, given that the odd slave cover 6I is rotated by 180° relative to the even slave covers 6P. The even 28P and odd 28I slave housings are identical, their function is only defined by the insertion direction of the blocking member.

In other words, the type of cover, i.e. even slave cover 6P or odd slave cover 6I, is defined by the insertion direction of the blocking member 32 into the slave housing.

When the blocking member 32 is arranged in the slave housing in the second insertion direction SI2, the odd slave cover 6I cannot be arranged on the frame 4 or removed from the frame 4 while the even slave cover 6P adjacent to said blocking member 32 is in place.

Thus, in order to open the hole 2, it is necessary first to remove the master cover 8, then the even cover 6P arranged between the master cover 8 and the odd cover 6I, then the odd cover 6I and finally the other even cover 6P arranged opposite the master cover 8.

It should be noted that the base body 16 of the odd slave cover 6I is identical to the base body 16 of the master cover 8 and the even slave covers 6P.

Moreover, the master cover 8 can include a bolt 80 adapted to lock the master cover 8 relative to the frame.

This alternative has a particularly low production cost, given that a single housing 28 is needed to define two types of cover.

One alternative not shown of a manhole 2 of FIG. 11 includes the following features. This manhole 2 differs from the manhole 2 of FIG. 11 only by the following.

The slave covers each comprise a base body 16 having a first slave housing, identical to the aforementioned slave housing 28, as well as a second slave housing that is separate from the first slave housing. This second slave housing is for example arranged in the middle of a side of the slave cover. When the blocking member 32 is received in the first slave housing, the cover 6 constitutes an even slave cover. When the blocking member is arranged in the second slave housing, the cover 6 constitutes an odd slave cover.

When the blocking member 32 is arranged in this second slave housing, the odd slave cover cannot be arranged on the frame 4 or removed from the frame 4 as long as the even slave cover adjacent to this slave housing is in place.

It should be noted that the base body of the odd slave cover is preferably identical to the base body of the master cover and the even slave covers.

To that end, each of the base bodies of the covers includes an even slave housing, an odd slave housing and a blocking housing. When the blocking member is inserted into the even slave housing, the cover constitutes an even slave cover. When the blocking member is inserted into the odd slave housing, the cover constitutes an odd slave cover. When a blocking member is inserted neither in the even slave housing nor in the odd slave housing, the cover constitutes a master cover.

In this way, a single base body 16 can be used to constitute a master cover, an even slave cover or an odd slave cover. Likewise, a same blocking member 32 can be used to create the desired type of cover. The manhole 2 therefore has a low production cost.

In an alternative that is not shown, the blocking member 32 is provided with anti-closing means adapted to oppose the closing of the cover when the latter is in the open position.

This anti-closing means is for example made in the form of a rod fastened to the core 40 only when the cover is in the open position. This rod extends between the two lugs 46 and its free end bears against the wall of the underground chamber, thereby opposing the untimely closing of the cover.

Lastly, the fact that the blocking member is mounted parallel to the cover plane in the associated housing facilitates the strength of said member in the housing.

What is claimed is:

1. A cover for a road system device comprising a frame, the cover comprising a blocking member; and a base body defining a covering surface for the road system device, extending in a cover plane, and having a housing for receiving the blocking member, wherein the housing and the blocking member are configured to block the cover relative to the frame or to a neighboring cover when the blocking member is in the housing, wherein the housing is configured to maintain the blocking member relative to the base body autonomously and to oppose a movement of the blocking member in a direction perpendicular to the cover plane and away from the covering surface; and the blocking member is a clamp comprising a core and two wings.

2. The cover according to claim 1, wherein the blocking member comprises a blocking lug intended to come into contact with a neighboring cover or with the frame so as to block the cover.

3. The cover according to claim 1, wherein the blocking lug protrudes from the core of the clamp on a side opposite the wings.

4. The cover according to claim 1, wherein the blocking member is symmetrical relative to an axis of symmetry.

5. The cover according to claim 1, wherein the cover comprises a subjugation component for subjugating the blocking member on the base body.

6. The cover according to claim 5, wherein the subjugation component cooperates with the blocking member by shape complementarity.

7. The cover according to claim 1, wherein at least one housing is delimited by a maneuvering recess of the cover, and in that the housing comprises a frangible wall that must be broken so as to put the blocking member in place in the housing.

8. The cover according to claim 1, wherein the cover includes a guide configured to guide the blocking member during placement of the blocking member in the housing.

9. The cover according to claim 1, wherein the base body and/or the blocking member is/are made from metal.

10. The cover according to claim 1, wherein the blocking member comprises an anti-closure configured to oppose closing of the cover when the latter is in an open position.

11. A road system device comprising:

a frame comprising an access opening; and at least two covers according to claim 1 both of which are configured to cover the access opening;

wherein each of said at least two covers can be either a first type of cover or a second type of cover, said first and second types of covers being different from each other;

the first type of cover is a slave cover and the second type of cover is a slave cover or a master cover, said master cover being configured to be placed and removed from the frame independently of the presence of the slave cover and said slave cover being unable to be removed from or installed in the frame when the master cover is placed in the frame; and each of said at least two covers comprises:

a blocking member which functions as an adaptation member; and

Wherein each of the covers is a cover according to clam 1, the blocking member being an adaptation member, in that a base body which comprises a first housing for receiving the respective adaptation member, in that when, in any cover, an adaptation member of the cover is in a respective first housing of the cover, the cover is the first type of cover that is a slave cover, and when, in any cover, an adaptation member of the cover is outside a respective first housing of the cover, the cover is the second type of cover that is a slave cover or a master cover.

12. The road system device according to claim 11, wherein, in any cover, the first housing is configured to receive the adaptation member either in one of different first and second insertion directions, and in that when the adaptation member is received in the first insertion direction into the first housing, the cover is the first type of cover, and when the adaptation member is received in the second insertion direction into the first housing, the cover is a third type of cover, said third type of cover being of a slave cover and different from the first and second types of cover.

13. The road system device according to claim 11, wherein each base body comprises a second housing, separate from the first housing and configured to receive the adaptation member and when the adaptation member is in the second housing, the cover is a third type of cover, said third type of cover being of a slave cover and different from the first and second types of cover.

14. The road system device according to claim 11, wherein the base body comprises a third housing, configured to receive a second blocking member, and in that when the second blocking member is in the third housing, this blocking member is configured to block one side of the cover relative to a side of the frame.

15. The road system device according to claim 11, wherein the base bodies of each of the covers are identical.

16. The road system device according to claim 11, wherein the two covers are of a different cover type, and the adaptation members of the two covers are identical.

17. The cover according to claim 1, wherein the clamp is substantially U-shaped.

18. The cover according to claim 6, wherein the subjugation component comprises a pin.

19. The cover according to claim 9, wherein the metal is cast iron.

20. The road system device according to claim 11, wherein the road system device is applicable to a manhole.

21. A cover for a road system device comprising a frame, the cover comprising a blocking member; and a base body defining a covering surface for the road system device, extending in a cover plane, and having a housing for receiving the blocking member, wherein the housing and the blocking member are configured to block the cover relative to the frame or to a neighboring cover when the blocking member is in the housing, the housing is configured to maintain the blocking member relative to the base body autonomously and to oppose a movement of the blocking member in a direction perpendicular to the cover plane and away from the covering surface;

the blocking member is a clamp comprising a core and two wings;

the blocking member comprises a blocking lug intended to come into contact with a neighboring cover or with the frame so as to block the cover.

the blocking lug protrudes from the core of the clamp on a side opposite the wings.

* * * * *

UNITED STATES PATENT AND TRADEMARK OFFICE

CERTIFICATE OF CORRECTION

PATENT NO. : 8,511,930 B2
APPLICATION NO. : 13/146505
DATED : August 20, 2013
INVENTOR(S) : Jean-Claude Royer et al.

It is certified that error appears in the above-identified patent and that said Letters Patent is hereby corrected as shown below:

On the Title Page:

Item 73, Assignee at line 1, Change "PM," to --PAM,--.

Item 57, Abstract at line 6, Change "member. The" to --member wherein the--.

Item 57, Abstract at line 8, Change "cover. The" to --cover, and the--.

Item 57, Abstract at lines 12-13, Change "surface. The invention is" to --surface, said road system device being--.

In the Claims:

In column 8 at line 54, In Claim 11, Change "clam" to --claim--.

In column 10 at line 25, In Claim 21, Change "cover." to --cover;--.

Signed and Sealed this
Twenty-ninth Day of April, 2014

Michelle K. Lee

Michelle K. Lee
*Deputy Director of the United States Patent and Trademark Office*